US005927081A

United States Patent [19]

Li

[11] Patent Number: 5,927,081

[45] Date of Patent: Jul. 27, 1999

[54] PULSE TUBE REFRIGERATOR AND ITS RUNNING METHOD

[75] Inventor: Rui Li, Hiratsuka, Japan

[73] Assignee: Sumitomo Heavy Industries, Ltd., Tokyo, Japan

[21] Appl. No.: 09/024,618

[22] Filed: Feb. 17, 1998

[30] Foreign Application Priority Data

Feb. 18, 1997 [JP] Japan ..... 9-034136

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 5,412,952 5/1995 Ohtani et al. ..... 62/6

5,647,218 7/1997 Kuriyama et al. ..... 62/6

5,720,172 2/1998 Ishizaki ..... 62/6

*Primary Examiner*—Ronald Capossela

*Attorney, Agent, or Firm*—Frishauf, Holtz, Goodman, Langer & Chick, P.C.

[57] ABSTRACT

A method of running a pulse tube refrigerator which has a regenerator and a pulse tube each defining a high temperature end and a low temperature end, the low temperature ends of the regenerator and the pulse tube being communicated with each other, and the high temperature end of the regenerator being connected to a gas compressor. A cold area is formed at the low temperature ends by periodically supplying working gas from the high temperature end of the regenerator to the regenerator and recovering the working gas from the regenerator. The temperature of the low temperature ends is raised by steadily, pulsatively or intermittently flowing gas in one direction through a communicating area between the low temperature ends of the regenerator and the pulse tube.

10 Claims, 9 Drawing Sheets

PULSE TUBE REFRIGERATOR AND ITS RUNNING METHOD

This application is based on Japanese Patent Application No. 9-34136 filed on Feb. 18, 1997, the entire contents of which are incorporated herein by reference.

BACKGROUND OF THE INVENTION a) Field of the Invention

The present invention relates to a pulse tube refrigerator, its running method, and a cryogenic system using such a pulse tube refrigerator, and more particularly to a pulse tube refrigerator capable of quickly raising the temperature of a low temperature end to room temperature, its running method, and a cryogenic system using such a pulse tube refrigerator.

b) Description of the Related Art

With reference to FIGS. 8A and 8B, the structure of a conventional pulse tube refrigerator and its running method will be described.

FIG. 8A shows an example of a conventional pulse tube refrigerator. The pulse tube refrigerator has a regenerator 100 with a high temperature end 100*a* and a low temperature end 100*b* and a pulse tube 101 with a high temperature end 101*a* and a low temperature end 101*b*. The low temperature ends 100*b* and 101*b* communicate with each other via a gas flow path 102. Regenerator material is filled in the regenerator 100, and the inside of the pulse tube 101 is vacant.

A gas jet port 103*a* and a gas suction port 103*b* of a gas compressor 103 communicate with the high temperature end 100*a* of the regenerator 100 via respective switching valves 104 and 105. The high temperature end 101*a* of the pulse tube 101 is made closed. A heater 106 is installed near at the low temperature end 101*b* of the pulse tube 101.

Cold areas are formed at the low temperature ends 100*b* and 101*b* by alternately opening and closing the switching valves 104 and 105 to impart a pressure change to working gas at the high temperature end 100*a* of the regenerator 100.

In order to raise the temperature of the low temperature ends to room temperature, the pulse tube refrigerator is stopped to raise the temperature through natural heat transfer, or the low temperature ends 100*b* and 101*b* are heated by turning the heater 106 on.

FIG. 8B shows another example of a conventional pulse tube refrigerator. In place of the gas compressor 103 shown in FIG. 8A, a gas compressor 107 having only one gas jet port 107*a* is used. The gas compressor 107 periodically jets out and sucks gas through the gas jet port 107*a*. The gas jet port 107*a* of the gas compressor 107 communicates directly with the high temperature end 100*a* of the regenerator 100. The other structures are the same as those shown in FIG. 8A.

Cold areas are formed at the low temperature ends 100*b* and 101*b* by running the gas compressor 107 to impart a pressure change to working gas at the high temperature end 100*a* of the regenerator 100. Similar to the example shown in FIG. 8A, in order to raise the temperature of the low temperature ends to room temperature, the pulse tube refrigerator is stopped to raise the temperature through natural heat transfer, or the low temperature ends 100*b* and 101*b* are heated by turning the heater 106 on.

Raising the temperature of the cooling ends is necessary for the maintenance of the pulse tube refrigerator, for the replacement of a material to be cooled, and for other purposes. It takes a long time to raise the temperature to room temperature through natural heat transfer so that an operation rate of the pulse tube refrigerator lowers and a manufacture cost rises.

Although it takes a relatively short time to raise the temperature to room temperature by forcibly heating the refrigerator with a heater, it is necessary to additionally prepare the heater, a heater power source, a heater controller and the like, so that the whole system of the refrigerator becomes complicated and the manufacture cost rises.

SUMMARY OF THE INVENTION

It is an object of the present invention to provide a pulse tube refrigerator and its running method, capable of raising the temperature of low temperature ends in a relatively short time.

According to one aspect of the present invention, there is provided a method of running a pulse tube refrigerator having a regenerator and a pulse tube each defining a high temperature end and a low temperature end, the low temperature ends of the regenerator and the pulse tube being communicated with each other, and the high temperature end of the regenerator being connected to a gas compressor, the method comprising: a cooling step of forming a cold area at the low temperature ends by periodically supplying working gas from the high temperature end of the regenerator to the regenerator and recovering the working gas from the regenerator; and a temperature raising step of raising the temperature of the low temperature ends by steadily, pulsatively or intermittently flowing gas in one direction through the communicating area between the low temperature ends of the regenerator and the pulse tube.

By flowing gas in one direction through the communicating area between the low temperature ends of the regenerator and the pulse tube, the temperature of the low temperature ends can be quickly raised.

According to another aspect of the present invention, there is provided a pulse tube refrigerator comprising: a regenerator filled in with regenerator material and defining a high temperature end and a low temperature end; a pulse tube defining a high temperature end and a low temperature end, the low temperature end of the pulse tube communicating with the low temperature end of the regenerator; a gas compressor for periodically jetting out and sucking gas via a gas jet port thereof; a first gas flow path capable of being opened and closed, the first gas flow path communicating the gas jet port of the gas compressor with the high temperature end of the regenerator; a second gas flow path capable of being opened and closed, the second gas flow path communicating the gas jet port of the gas compressor with the high temperature end of the regenerator, and being capable of flowing gas only in the direction toward the regenerator or in the direction toward the gas compressor; and a third gas flow path capable of being opened and closed, the third gas flow path communicating the gas jet port of the gas compressor with the high temperature end of the pulse tube, and capable of flowing gas only in the direction toward the gas compressor if the second gas flow path can flow gas only in the direction toward the regenerator, or flowing gas only in the direction toward the pulse tube if the second gas flow path can flow gas only in the direction toward the gas compressor.

In order to raise the temperature of the low temperature ends of the regenerator and the pulse tube, the first gas flow path is closed and the second and third gas flow paths are opened. While the gas compressor jets out gas, gas flows through only one of the second and third gas flow paths, whereas while the gas compressor sucks gas, gas flows through only the other of the second and third gas flow paths. A gas flow in one direction is therefore formed in the regenerator and pulse tube. This gas flow quickly rises the temperature of the low temperature ends.

According to a still further aspect of the invention, there is provided a pulse tube refrigerator comprising: a regenerator filled in with regenerator material and defining a high temperature end and a low temperature end; a pulse tube defining a high temperature end and a low temperature end, the low temperature end of the pulse tube communicating with the low temperature end of the regenerator; a buffer chamber communicating with the high temperature end of the pulse tube via a flow path impedance intervened therebetween; a gas compressor having a jet port for jetting out high pressure gas and a suction port for sucking gas; a first gas flow path capable of being opened and closed, the first gas flow path communicating the jet port of the gas compressor with the high temperature end of the regenerator; a second gas flow path capable of being opened and closed, the second gas flow path communicating the suction port of the gas compressor with the high temperature end of the regenerator; and a third gas flow path capable of being opened and closed, the third gas flow path communicating one of the jet port and the suction port of the gas compressor with the buffer chamber or a gas flow path between the high temperature end of said pulse tube and said flow path impedance.

If the third gas flow path is connected to the jet port of the gas compressor, the first gas flow path is closed and the second gas flow path is opened. If the third gas flow path is connected to the suction port of the gas compressor, the second gas flow path is closed and the first gas flow path is opened. In this state, a closed gas flow path is formed from the jet port to suction port of the gas compressor, including the regenerator and pulse tube. Since a gas flow in one direction is formed in the regenerator and pulse tube, the temperature of the low temperature ends can be quickly raised.

The temperature of the low temperature ends of the pulse tube refrigerator can be raised in a relatively short time. It takes therefore a short time to exchange a material to be cooled.

DETAILED DESCRIPTION OF THE PREFERRED EMBODIMENTS

Figure 1A:
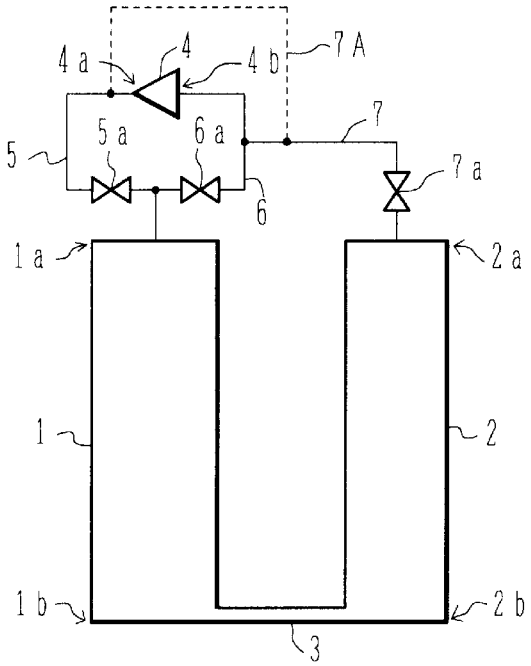
FIGS. 1A to 1C are schematic diagrams showing pulse tube refrigerators according to first and second embodiments of the invention.

FIG. 1A is a schematic diagram showing a pulse tube refrigerator according to the first embodiment of the invention. The pulse tube refrigerator has a regenerator 1 with a high temperature end 1*a* and a low temperature end 1*b* and a pulse tube 2 with a high temperature end 2*a* and a low temperature end 2*b*. The low temperature ends 1*b* and 2*b* communicate with each other via a gas flow path 3. Regenerator material is filled in the regenerator 1, and the inside of the pulse tube 2 is vacant.

A gas jet port 4*a* and a gas suction port 4*b* of a gas compressor 4 communicate with the high temperature end 1*a* of the regenerator 1 via gas flow paths 5 and 6 respectively having switching valves 5*a* and 6*a*. The high temperature end 2*a* of the pulse tube 2 communicates with the gas suction port 4*b* of the gas compressor 4 via a gas flow path 7 having a switching valve 7*a*. The gas compressor 4 may be a compressor of a rotary type or a scroll type, and steadily or pulsatively jets out gas from the gas jet port 4*a*.

Next, the method of running the pulse tube refrigerator shown in FIG. 1A will be described. The switching valve 5*a* is opened and the switching valves 6*a* and 7*a* are closed. In this state, working gas flows from the gas compressor 4 into the regenerator 1. The working gas in the regenerator 1 raises its pressure while being compressed. A portion of the working gas flows via the gas flow path 3 into the pulse tube 3. Next, the switching valve 5*a* is closed and the switching valve 6*a* is opened, with the switching valve 7*a* being maintained closed. The working gas in the regenerator 1 is recovered in the gas compressor 4 and the pressure in the regenerator 1 lowers. A portion of the working gas in the pulse tube 2 is moved via the gas flow path 3 back to the regenerator 1. By alternately opening and closing the switching valves 5*a* and 6*a,* the above operations are repeated.

A flow path resistance of the regenerator 1, the presence of the pulse tube 2, and other factors produce a phase shift between a pressure change and a displacement of the working gas at the low temperature end 2*b* of the pulse tube 2.

This phase shift and the repetition of compression/expansion of the working gas form a cold area near at the low temperature end 2*b* of the pulse tube 2.

If the temperature of the low temperature end 2*b* of the pulse tube 2 is to be raised to room temperature, the switching valves 5*a* and 7*a* are opened and the switching valve 6*a* is closed. Working gas jetted out of the gas compressor 4 is recovered in the gas compressor 4 en route from the gas flow path 5, regenerator 1, gas flow path 3, pulse tube 2 and to the gas flow path 7. Namely, a gas flow is formed in one direction in the regenerator 1, gas flow path 3 and pulse tube 2. This gas flow in one direction serves as the medium for quickly raising the temperature of the low temperature end 2*b* of the pulse tube 2 to room temperature. As compared to the temperature rising through natural heat transfer, it is possible to raise the temperature to room temperature in a shorter time. Furthermore, since an additional component such as a heater is not used, the structure of the pulse tube refrigerator does not become complicated. If the gas compressor 4 steadily jets out gas, a steady gas flow is formed in the regenerator 1, gas flow path 3 and pulse tube 2, whereas if the gas compressor 4 pulsatively jets out gas, a pulsative gas flow is formed.

In the above description of the temperature raising process, gas is flowed from the regenerator 1 to the pulse tube 2 via the gas flow path 3. The gas may be flowed in the opposite direction. As indicated by a broken line 7A shown in FIG. 1A, the gas flow path 7 is connected to the gas jet port 4*a* of the gas compressor 4, and the switching valve 5*a* is closed and the switching valves 6*a* and 7*a* are opened to flow the gas in the opposite direction.

Figure 1B:
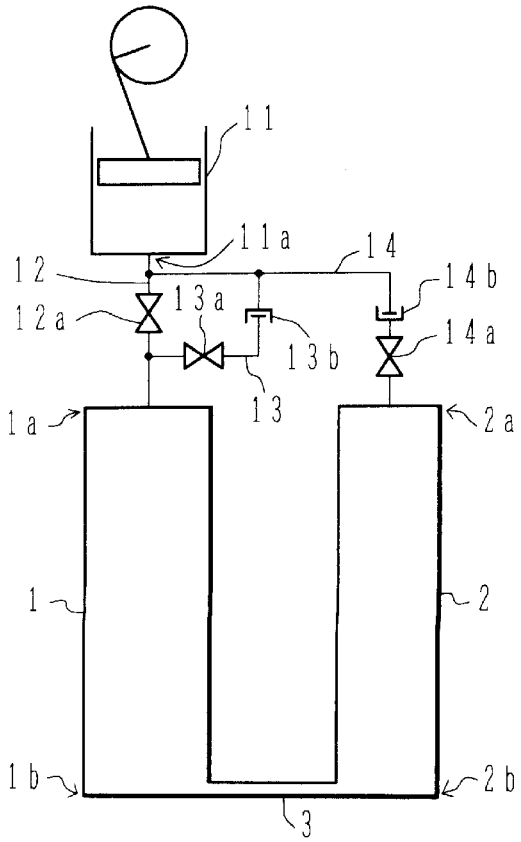

FIG. 1B is a schematic diagram showing a pulse tube refrigerator according to the second embodiment of the invention. The structures of a regenerator 1, a pulse tube 2 and a gas flow path 3 are the same as those shown in FIG. 1A. A gas jet port 11*a* of a gas compressor 11 communicates with the high temperature end 1*a* of the regenerator 1 via a gas flow path 12 having a switching valve 12*a*. The gas compressor 11 periodically ejects and sucks working gas through the gas jet port 11*a*.

The gas jet port 11*a* of the gas compressor 11 communicates with the high temperature end 1*a* of the regenerator 1 via a gas flow path 13 having a serial connection of a switching valve 13*a* and a relief valve 13*b*. The gas jet port 11*a* also communicates with the high temperature end 2*a* of the pulse tube 2 via a gas flow path 14 having a serial connection of a switching valve 14*a* and a relief valve 14*b*.

The relief valve 13*b* allows gas to flow from the gas compressor 11 to the regenerator 1 if the pressure in the gas compressor 11 is higher than that in the regenerator and only if the pressure difference is equal to or larger than a preset value, and does not allow gas to flow if the pressure difference is smaller than the preset value or the pressure in the gas compressor is lower than that in the regenerator. Conversely, the relief valve 14*b* allows gas to flow from the pulse tube 2 to the gas compressor 11 if the pressure in the pulse tube 2 is higher than that in the gas compressor 11 and only if the pressure difference is equal to or larger than a preset value.

In order to form a cold area by operating upon this pulse tube refrigerator, the switching valves 13*a* and 14*a* are closed and the switching valve 12*a* is opened. When the gas compressor 11 starts running, the pressure at the high temperature end 1*a* of the regenerator 1 periodically changes, and a cold area is formed at the low temperature end 2*b* of the pulse tube 2, because of the same principle as described with FIG. 1A.

If the temperature of the low temperature end 2*b* is to be raised, the switching valve 12*a* is closed and the switching valves 13*a* and 14*a* are opened. While the gas compressor 11 jets out gas, the relief valve 13*b* is open, and the working gas is supplied to the regenerator, whereas while the gas compressor 11 sucks gas, the relief valve 14*b* is open and the working gas in the pulse tube 2 is recovered in the gas compressor 11. These operations are repeated so that an intermittent gas flow is formed in one direction from the regenerator 1 to the gas flow path 3 and to the pulse tube 2. Therefore, similar to the case shown in FIG. 1A, the temperature of the low temperature end 2*b* of the pulse tube 2 can be quickly raised to room temperature.

Figure 1C:
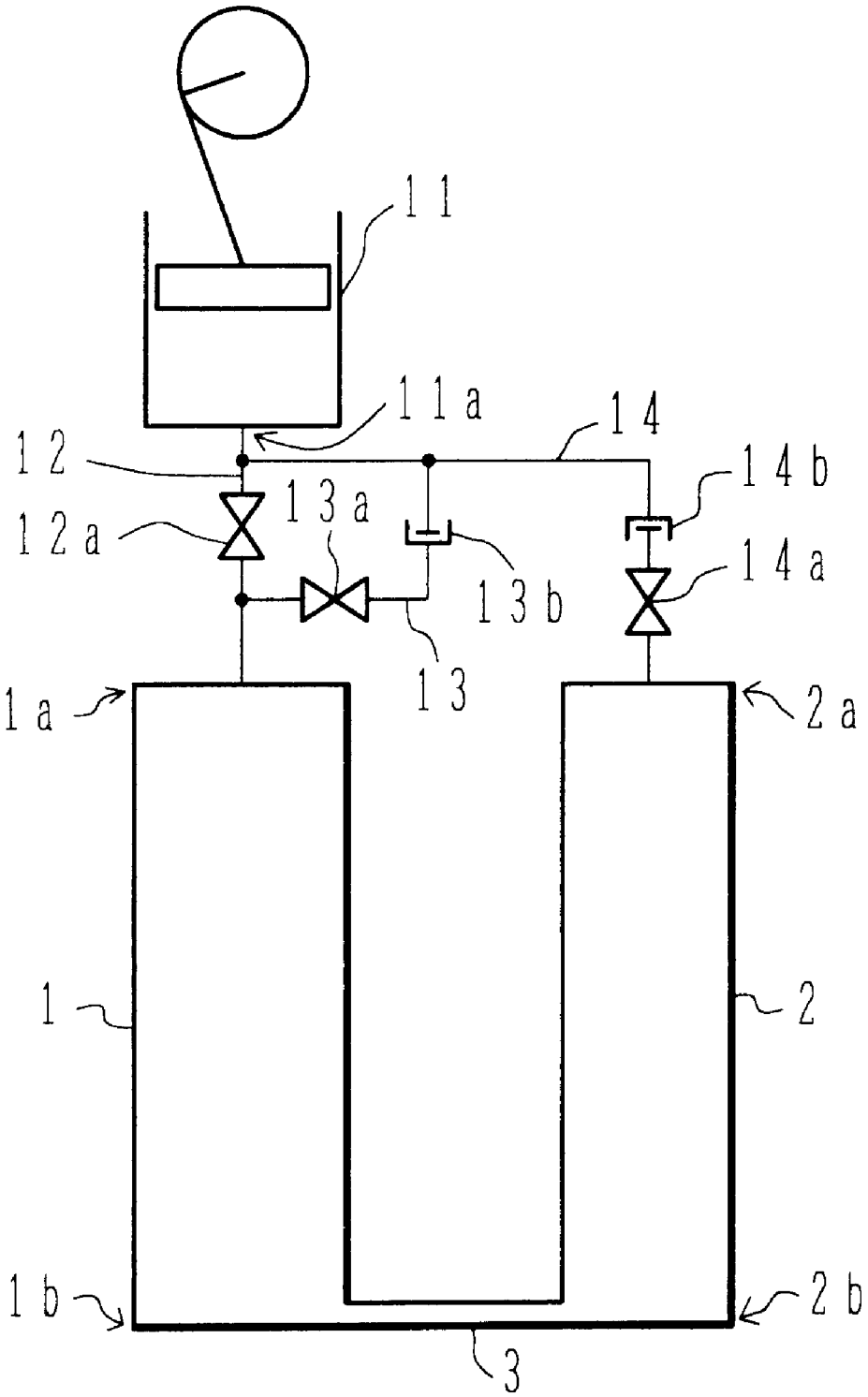

The connection directions of the relief valves 13*b* and 14*b* may by reversed as shown in FIG. 1C. In this case, an intermittent gas flow is formed in one direction from the pulse tube 2 to the gas flow path 3 and to the regenerator 1.

Figure 2:
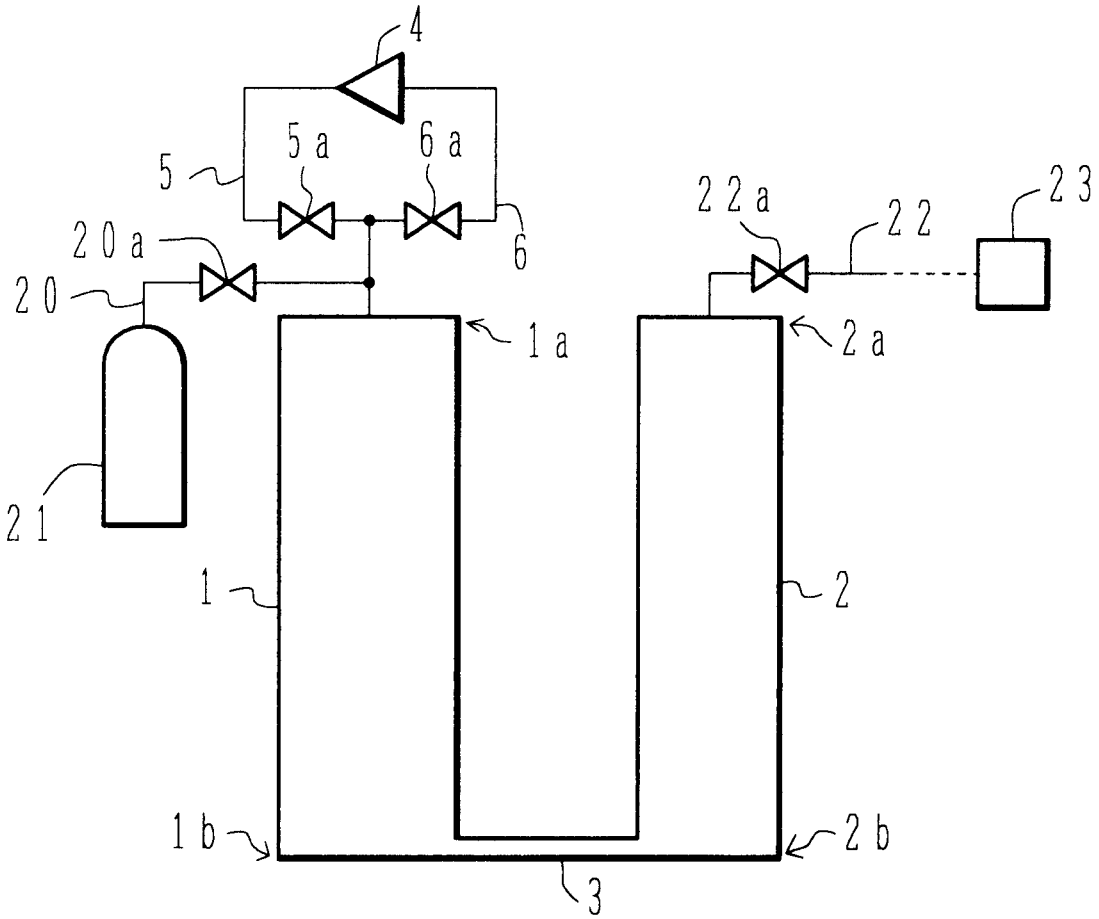
FIG. 2 is a schematic diagram showing a pulse tube refrigerator according to a third embodiment of the invention.

FIG. 2 is a schematic diagram showing a pulse tube refrigerator according to the third embodiment of the invention. The structures of a regenerator 1, a pulse tube 2, a gas flow path 3, a gas compressor 4, and gas flow paths 5 and 6 are the same as those shown in FIG. 1A.

The high temperature end 1*a* of the regenerator 1 communicates with a high pressure gas source 21 via a gas flow path 20 having a switching valve 20*a*. The high temperature end 2*a* of the pulse tube 2 is connected to one end of a gas flow path 22 having a switching valve 22*a*, and the other end of the gas flow path 22 is made open to the atmospheric air.

In order to form a cold area by operating upon this pulse tube refrigerator, the switching valves 20*a* and 22*a* are closed and the switching valves 5*a* and 6*a* are alternately opened and closed. Similar to the case of FIG. 1A, a cold area is formed at the low temperature end 2*b* of the pulse tube 2.

If the temperature of the low temperature end 2*b* is to be raised, the switching valves 5*a* and 6*a* are closed and the switching valves 20*a* and 22*a* are opened. In this state, gas is supplied from the high pressure gas source 21 to the regenerator 1 and discharged to the external en route from the gas flow path 3, pulse tube 2 and to the gas flow path 22. Since a gas flow is formed in one direction at the low temperature end 2*b* of the pulse tube 2, the temperature of the low temperature end 2*b* can be quickly raised to room temperature. The direction of the gas flow may be reversed. A low pressure gas source 23 may be connected to the open end of the gas flow path 22. The low pressure gas source 23 may be a vacuum pump.

Figure 3:
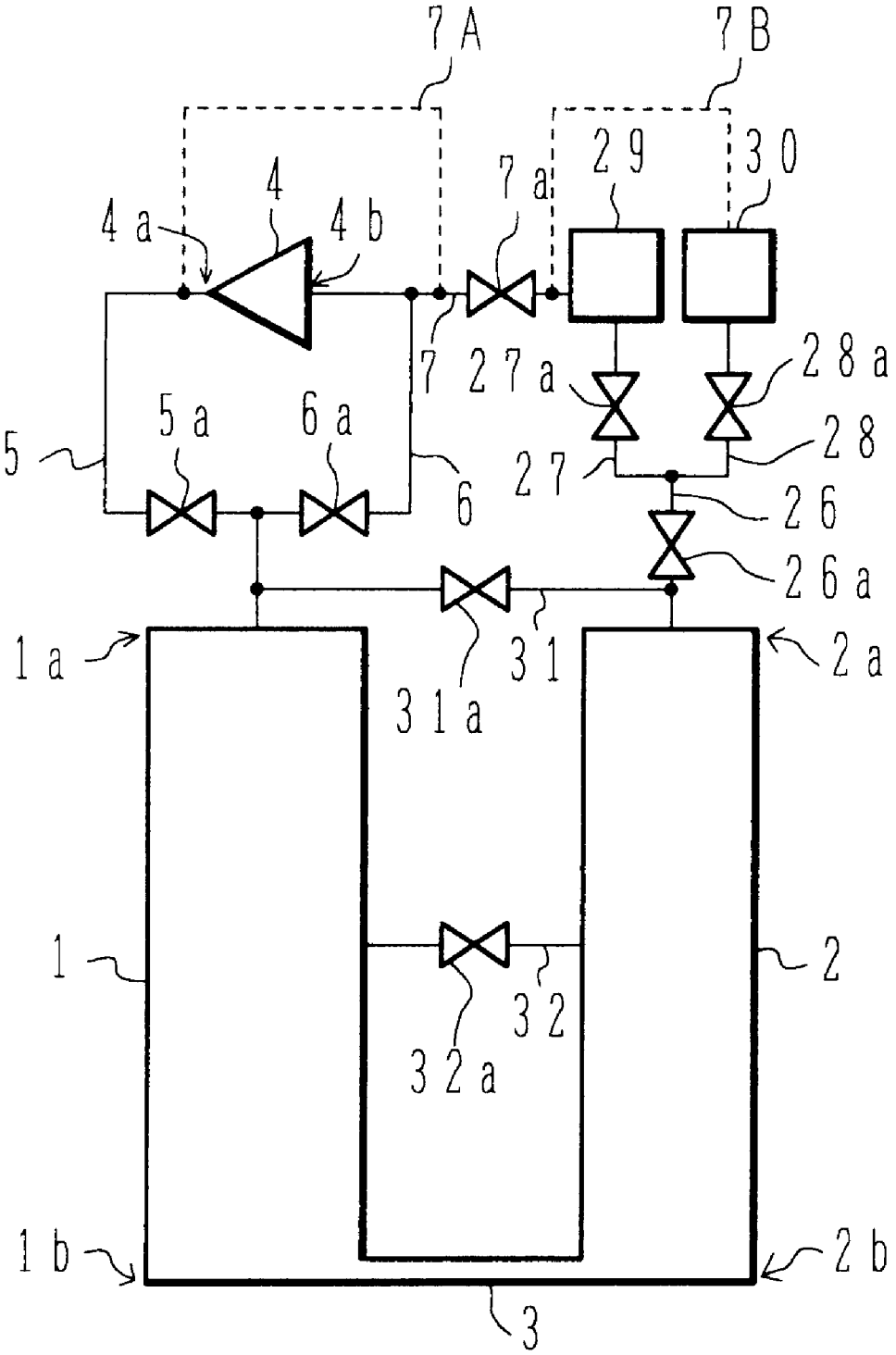
FIG. 3 is a schematic diagram showing a modification of the pulse tube refrigerator of the first embodiment.

FIG. 3 is a schematic diagram showing a modification of the pulse tube refrigerator of the first embodiment. The structures of a regenerator 1, a pulse tube 2, a gas flow path 3, a gas compressor 4, and gas flow paths 5 and 6 are the same as those shown in FIG. 1A.

The high temperature end 2*a* of the pulse tube 2 is connected to one end of a gas flow path 26 having a flow path impedance variable valve 26*a*. The other end of the gas flow path 26 is branched into gas flow paths 27 and 28 which communicate with respective buffer chambers 29 and 30. The gas flow paths 27 and 28 have respective switching valves 27*a* and 28*a*. The buffer chamber 29 communicates with a gas suction port 4*b* of the gas compressor 4 via a gas flow path 7 having a switching valve 7*a*.

The high temperature ends 1*a* and 2*a* of the regenerator 1 and pulse tube 2 communicate with each other via a gas flow path 31 having a flow path resistance variable valve 31*a*. The near middle portions of the regenerator 1 and pulse tube 2 communicate with each other via a gas flow path 32 having a gas flow resistance variable valve 32*a*.

In order to form a cold area by operating upon this pulse tube refrigerator, the switching valve 7*a* is closed and the switching valves 5*a* and 6*a* are alternately opened and closed. If the flow path impedance variable valves 26*a*, 31*a* and 32*a* are closed, the structure of this pulse tube refrigerator is the same as that shown in FIG. 1A and a cold area can be formed at the low temperature end 2*b* of the pulse tube 2. A phase shift between a pressure change and a displacement of the working gas in the pulse tube 2 can be changed by opening and closing the switching valves 27*a* and 28*a* according to a preset time table and controlling the flow path resistances of the flow path impedance variable valves 26*a*, 31*a* and 32*a*. A cooling capacity can be improved by setting this phase shift in a proper range.

If the temperature of the low temperature end 2*b* is to be raised, the switching valve 6*a*, flow path resistance variable valves 31*a* and 32*a* are closed and the switching valves 7*a* and 27*a* and flow path impedance variable valve 26*a* are opened. In this state, working gas jetted out of the gas compressor 4 is recovered in the gas compressor 4 en route from the regenerator 1, gas flow path 3, pulse tube 2, gas flow paths 26 and 27, buffer chamber 29 and to the gas flow path 7. Since a gas flow is formed in one direction at the low temperature end 2*b* of the pulse tube 2, the temperature of the low temperature end 2*b* can be quickly raised to room temperature, similar to the case of FIG. 1A. As indicated by a broken line 7A shown in FIG. 3, the gas flow path 7 may be connected to the gas jet port 4*a* of the gas compressor 4. In this case, the switching valve 5*a* is closed and the switching valve 6*a* is opened to flow the gas in the opposite direction. Furthermore, as indicated by a broken line 7B, the gas flow path 7 may be branched to be connected to a plurality of buffer chambers.

The gas flow path 7 may be connected to the high temperature end 2*a* of the pulse tube 2 as shown in FIG. 1A, or may be connected to a gas flow path between the path impedance variable valve 26*a* and the switching valve 27*a* as indicated by a broken line 7C.

Figure 4:
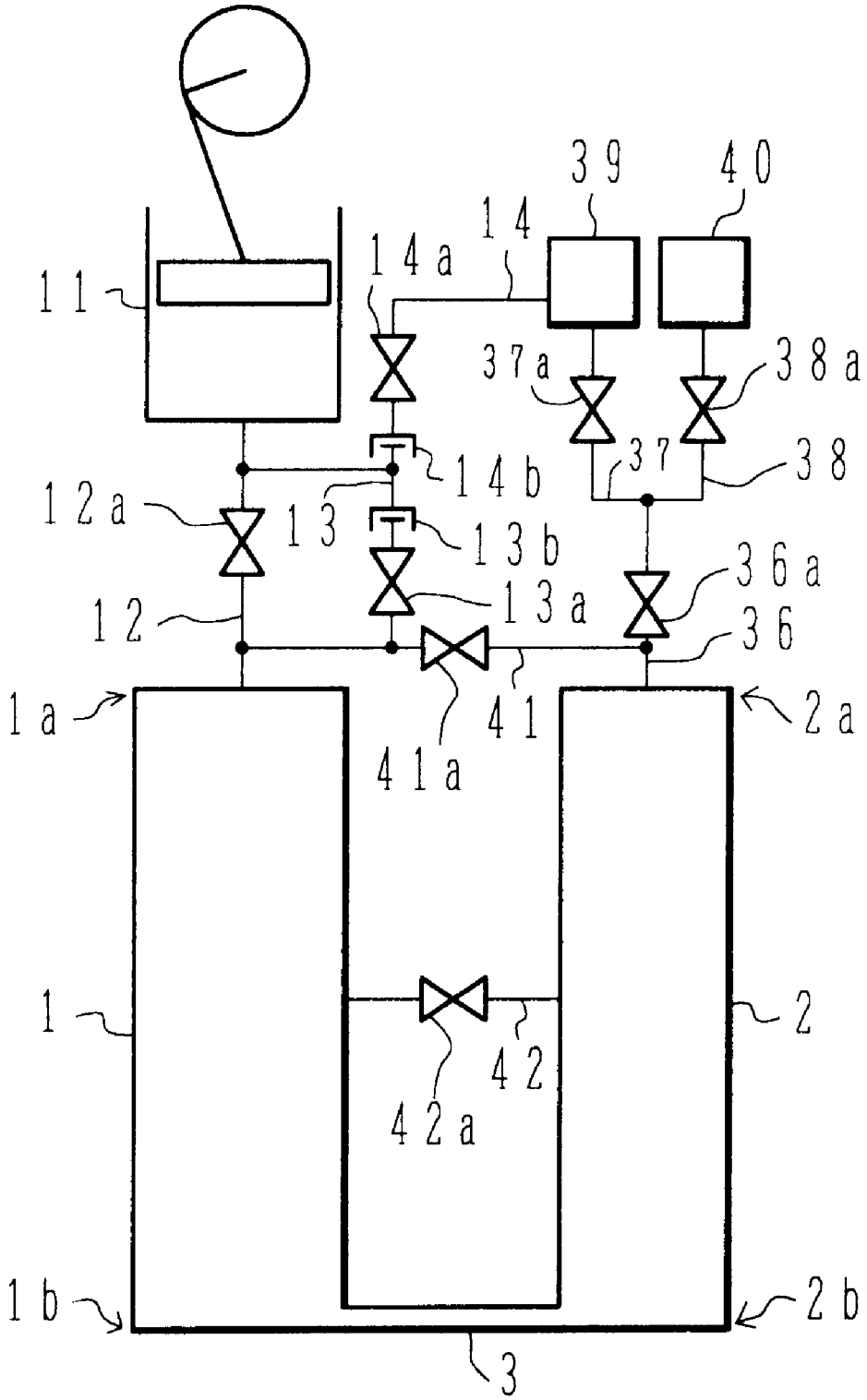
FIG. 4 is a schematic diagram showing a modification of the pulse tube refrigerator of the second embodiment.

FIG. 4 is a schematic diagram showing a modification of the pulse tube refrigerator of the second embodiment. The structures of a regenerator 1, a pulse tube 2, a gas flow path 3, a gas compressor 11, and a gas flow path 12 are the same as those shown in FIG. 1B. The high temperature end 2*a* of the pulse tube 2 is connected to gas circulation systems similar to the pulse tube refrigerator shown in FIG. 3, i.e., to a gas flow path 36 having a flow path resistance variable valve 36*a,* gas flow paths 37 and 38 having respective switching valves 37*a* and 38*a,* and to buffer chambers 39 and 40. Connected between the regenerator 1 and pulse tube 2 is a gas circulation system similar to the pulse tube refrigerator shown in FIG. 3, i.e., gas flow paths 41 and 42 having respective flow path resistance variable valves 41*a* and 42*a*.

Although the gas flow path 14 shown in FIG. 1B communicates directly with the high temperature end 2*a* of the pulse tube 2, the gas flow path 14 shown in FIG. 4 is connected to the buffer chamber 39 and communicates with the high temperature end 2*a* of the pulse tube 2 via the gas flow paths 37 and 36. The connection of the gas flow path 13 is the same as that shown in FIG. 1B.

In order to form a cold area by operating upon this pulse tube refrigerator, the switching valves 13*a* and 14*a* are closed and the switching valve 12*a* is opened. In this state, a gas flow same as FIG. 1B is formed and a cold area is formed at the low temperature end 2*b* of the pulse tube 2. As described with FIG. 3, a cooling capacity can be improved by controlling the flow path resistances of the flow path resistance variable valves 36*a,* 41*a* and 42*a* under the conditions that the switching valves 37*a* and 37*b* are opened and closed according to a preset time table.

If the temperature of the low temperature end 2*b* is to be raised, the switching valve 12*a,* flow path resistance variable valves 41*a* and 42*a* are closed and the switching valves 13*a,* 14*a* and 37*a* and flow path resistance variable valve 36*a* are opened. In this state, similar to the case of FIG. 1B, while the gas compressor 11 jets out gas, the relief valve 13*b* is open so that working gas is supplied to the regenerator. While the gas compressor 11 sucks the working gas, the relief valve 14*b* is open so that the gas in the pulse tube 2 is recovered in the gas compressor 11 en route from the gas flow paths 36 and 37 and to the buffer chamber 39. The above operations are repeated so that a intermittent gas flow is formed in one direction in the regenerator 1, gas flow path 3 and pulse tube 2. It is therefore possible to quickly raise the temperature of the low temperature end 2*b* of the pulse tube, similar to the case of FIG. 1B.

The experiment results of evaluating a temperature raising time of the pulse tube refrigerator of the first embodiment will be described by comparing with a conventional temperature raising method.

Figure 5:
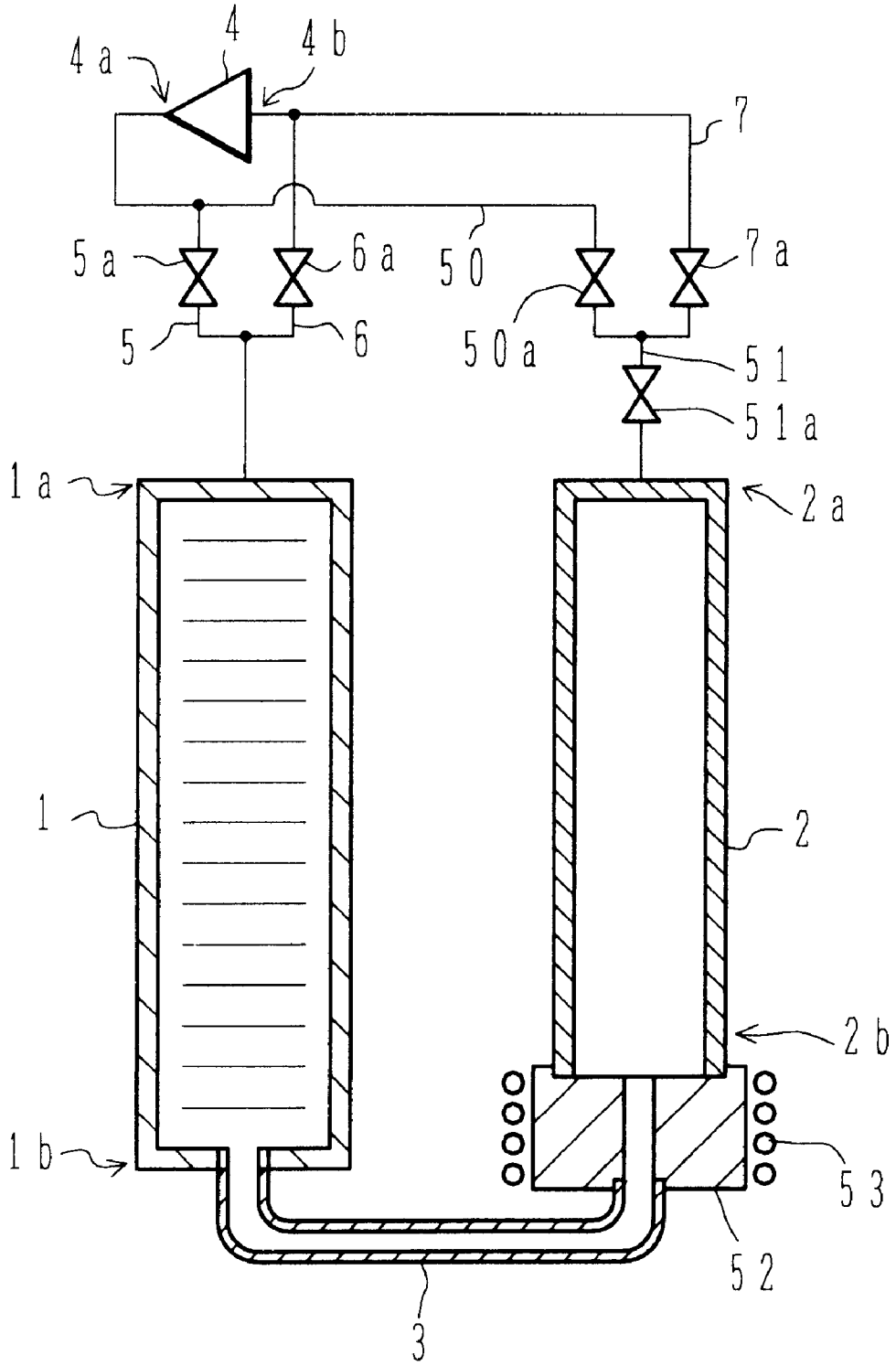
FIG. 5 is a schematic diagram showing a pulse tube refrigerator used for the experiments of evaluating the effects of the embodiment.

FIG. 5 is a schematic diagram showing a pulse tube refrigerator used for the evaluation experiments. The structures of a gas compressor 4, gas flow paths 5 and 6, a regenerator 1, a pulse tube 2, and a gas flow path 3 are basically the same as those of the pulse tube refrigerator shown in FIG. 1A. Although the gas flow path 7 communicating with the gas suction port 4*b* of the gas compressor 4 shown in FIG. 1A is directly connected to the high temperature end 2*a* of the pulse tube 2, the gas flow path 7 shown in FIG. 5 is connected to the high temperature end 2*a* via a gas flow path 51 having a flow path resistance variable valve 51*a*. The high temperature end 2*a* also communicates with the gas jet port 4*a* of the gas compressor 4 via a gas flow path 50 having a switching valve 50*a* and via the gas flow path 51. During the cooling process, the switching valves 5*a* and 6*a* are alternately opened and closed and the switching valves 7*a* and 50*a* are opened and closed at predetermined timings to thereby set the flow path resistance of the flow path resistance variable valve 51*a* to a proper value and optimize the phase relationship between the pressure change and replacement of the working gas in the pulse tube 2. In this manner, a high cooling capacity can be realized.

A cold stage 52 made of copper is thermally coupled to the low temperature end 2*b* of the pulse tube 2. A heater 53 having a resistance of 50Ω is disposed around the cold block 52 for the comparison with the conventional temperature raising method.

The regenerator 1 is 38 mm in diameter and 170 mm in length, and has about 2000 stainless mesh disks of #250 filled therein. The pulse tube 2 is 28 mm in diameter and 200 mm in length, and the cold stage 52 is 30 mm in length. Helium gas was used as working gas, the open/close frequency of the switching valves 5*a* and 6*a* was set to 2 Hz, and the cold stage 52 was cooled to a temperature of 27 K.

Figure 6:
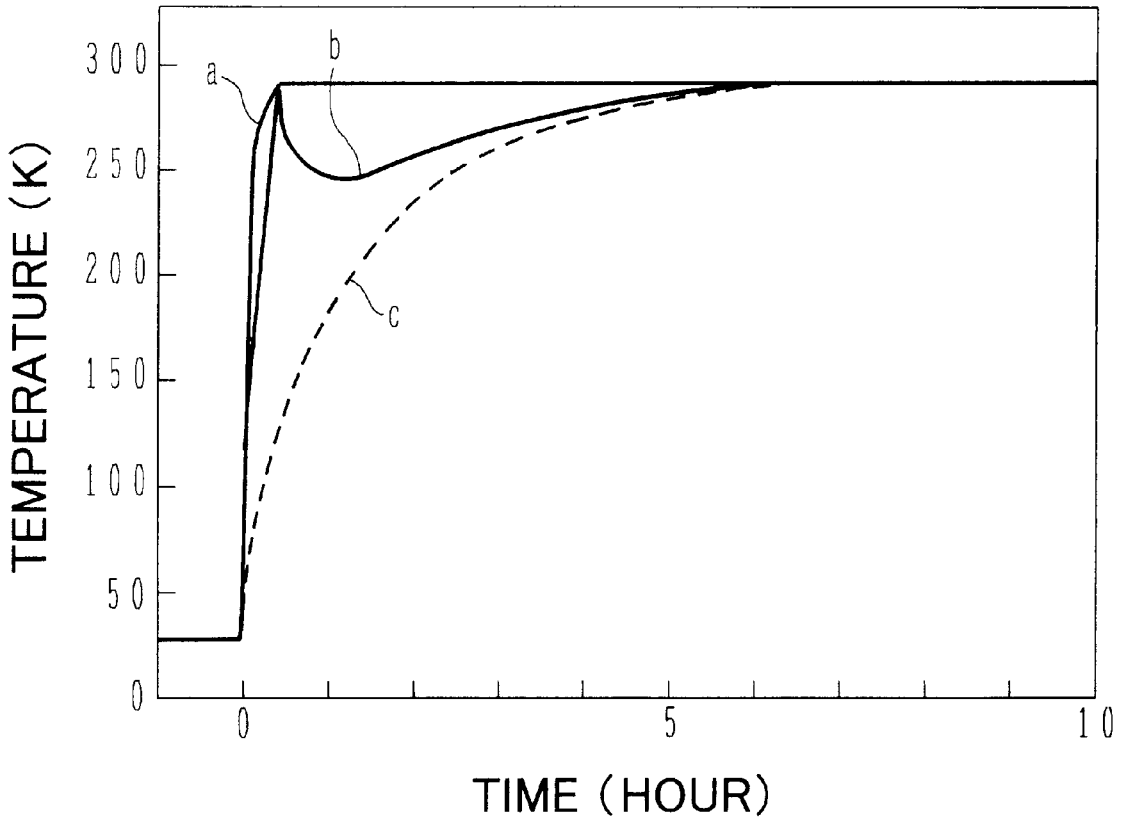
FIG. 6 is a graph showing the evaluation results of temperature changes of the cold stage.

FIG. 6 is a graph showing a temperature change of the cold stage 52 during the temperature raising process. The abscissa represents a lapse time, in the unit of hour, from the end of a cooling operation, and the ordinate represents an absolute temperature of the cold stage 52. A thick solid line a in FIG. 6 indicates a temperature change according to the embodiment method of the invention wherein a gas flow was formed in one direction in the regenerator 1, gas flow path 3 and pulse tube 2 under the conditions that the switching valves 6*a* and 50*a* were closed, that the switching valves 5*a* and 7*a* were opened, and that the flow path resistance variable valve 51*a* was fully opened. A thin solid line b indicates a temperature change obtained by stopping the gas compressor 4 and turning the heater 53 on, and a broken line c indicates a temperature change obtained by a temperature raising process through natural heat transfer.

As indicated by the solid line a, with the embodiment temperature raising method of the invention, the temperature was raised to room temperature in about 20 minutes after the start of temperature rise and maintained generally constant thereafter. In contrast, in the case of heating with the heater 53, although the temperature once reached room temperature in about 20 minutes after the start of temperature rise as indicated by the solid line b, when the power supply is stopped it again lowered and thereafter gradually rose to room temperature after about 7 hours. This may be ascribed to the following assumption. Since only the cold stage 52 is locally heated, the low temperature end 1*b* of the regenerator 1 and the like do not take room temperature even when the cold stage 52 reaches room temperature. And after the power supply to the heater 53 is stopped, heat of the cold stage 52 is transferred to the low temperature end 1*b* of the regenerator 1 and the like. In order to prevent the temperature from lowering again after the power supply is stopped, the power supply is not stopped immediately, but it is maintained unstopped by controlling the voltage and current of the heater 53 with a heater controller while the temperature at the low temperature end is monitored. With the embodiment method, however, the temperature in the regenerator 1, gas flow path 3 and pulse tube 2 is generally uniformly raised so that once the temperature is raised to room temperature, it maintains nearly constant. In this case, even if the compressor is stopped and the gas flow in one direction disappears, the temperature will not lower again. In the case of temperature raising through natural heat transfer, room temperature was obtained in about 9 hours after the start of temperature rise, as indicated by the broken line c.

With this embodiment method, it is possible therefore to raise the temperature to room temperature in a shorter time than by temperature raising through natural heat transfer. As compared to the use of the heater, the temperature of the cold stage 52 can be stabilized in a short time.

In the above embodiments, the regenerator of one stage structure is used. A regenerator of a multiple-stage structure may be used with a pulse tube refrigerator.

Figure 7:
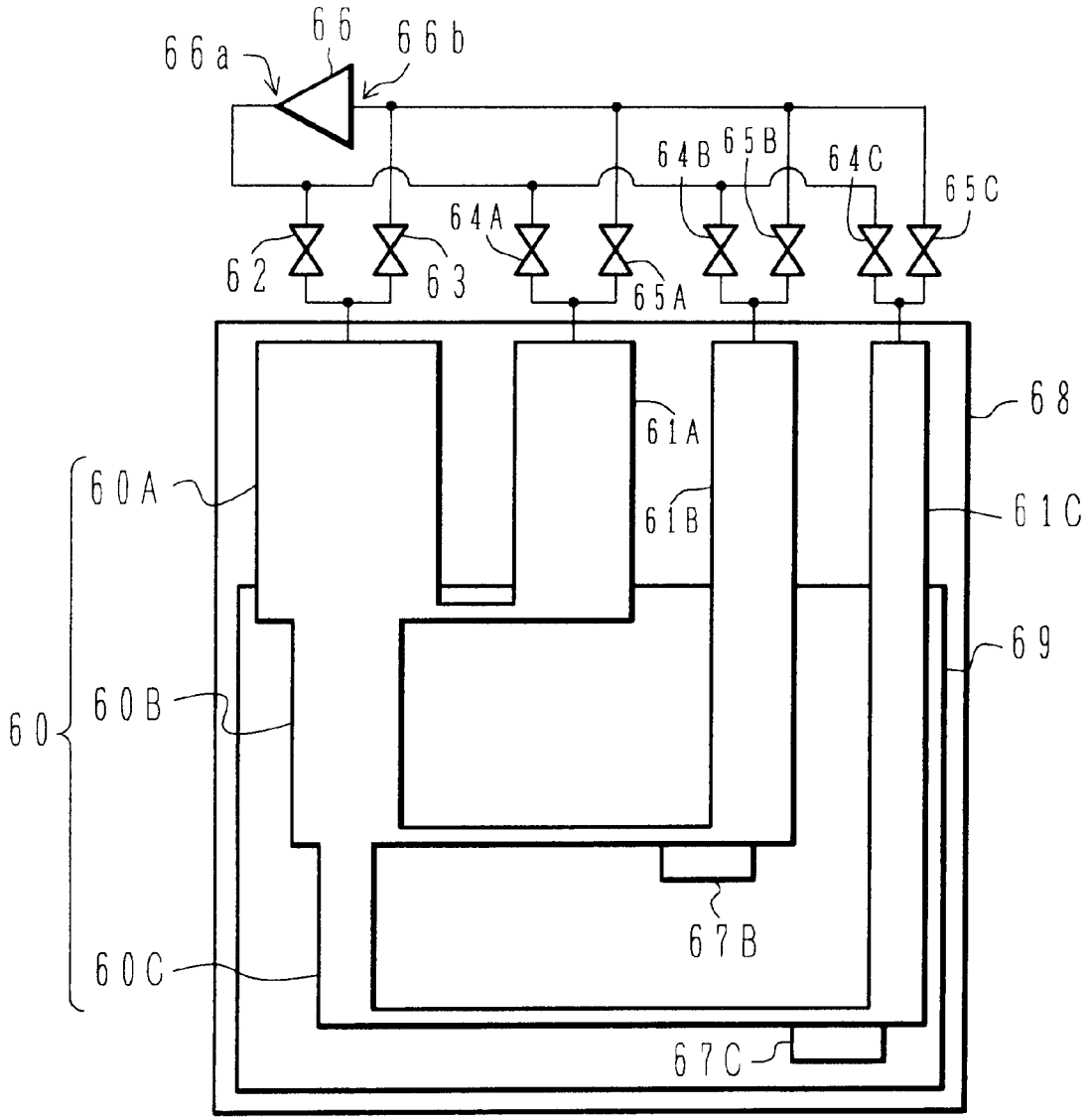
FIG. 7 is a schematic diagram showing a cryogenic system cryogenic a pulse tube refrigerator of a three-stage structure according to another embodiment of the invention.
Figure 8A:
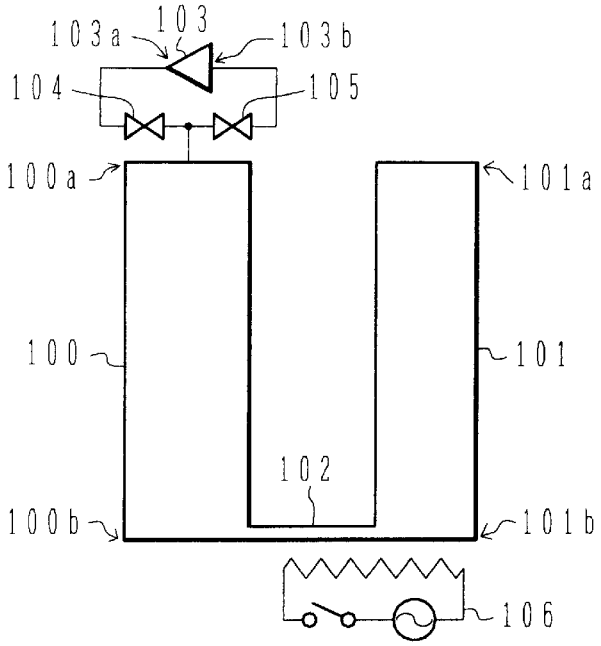
FIG.8A PRIOR ART
FIGS. 8A and 8B are schematic diagrams showing conventional pulse tube refrigerators.
Figure 8B:
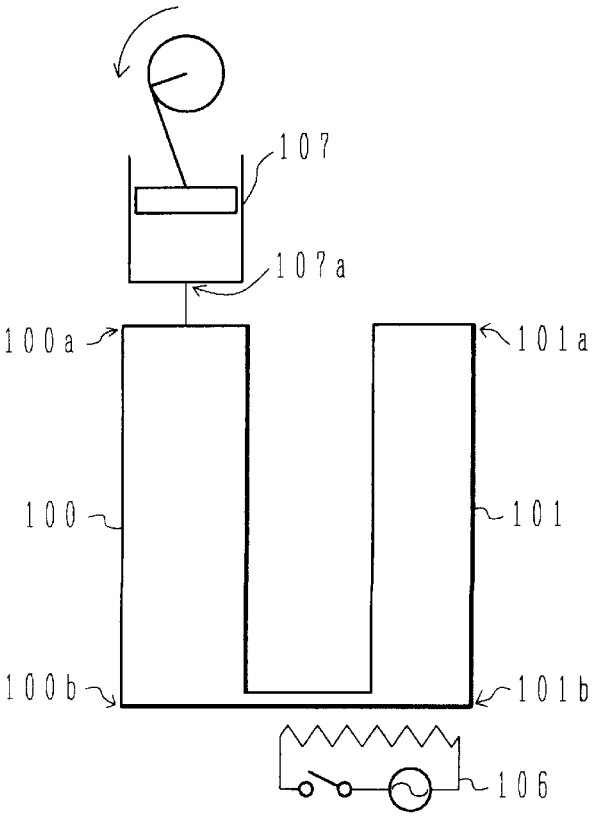
FIG.8B PRIOR ART

FIG. 7 is a schematic diagram showing a cooling system using a pulse tube refrigerator with a regenerator of a three-stage structure. The regenerator 60 is constituted of a first stage regenerator 60A, a second stage regenerator 60B, and a third stage regenerator 60C. Pulse tubes 61A, 61B and 61C communicate with low temperature ends of the first to third stage regenerators 60A, 60B and 60C.

The high temperature end of the first stage 60A of the regenerator 60 communicates with the gas jet port 66*a* of a gas compressor 66 via a switching valve 62, and with the gas suction port 66*b* of the gas compressor 66 via a switching valve 63. The high temperature ends of the pulse tubes 61A, 61B and 61C communicate with the gas jet port 66*a* of the gas compressor 66 via switching valves 64A, 64B and 64C, and with the gas suction port 66*b* of the gas compressor 66 via switching valves 65A, 65B and 65C.

The regenerator 60 and pulse tubes 61A to 61C are housed in a vacuum chamber 68. The low temperature ends of the pulse tubes 61A to 61C, the low temperature end of the first stage 60A of the regenerator 60, and the second and third stages 60B and 60C are thermally isolated with a heat isolating member 69 from the external environment. Materials 67B and 67C to be cooled are mounted on the low temperature ends of the pulse tubes 61B and 61C.

For example, in order to raise the temperature of the low temperature ends, the switching valves 62, 65A to 65C are opened and the switching valves 63, 64A to 64C are closed. In this state, a gas flow is formed in one direction in the regenerator 60 and pulse tubes 61A to 61C. Therefore, the temperatures of the low temperature ends of the pulse tubes 61A to 61C can be raised in a short time. The switching valves for only some of the pulse tubes 61A to 61C may be opened to flow gas only to the low temperature ends of the corresponding stages.

The high temperature end of the pulse tube at each stage shown in FIG. 7 may be connected with the flow path resistance variable valve 26*a* and buffer chamber 29 shown in FIG. 3. In this case, the switching valves 64A to 64C and 65A to 65C are connected to the corresponding buffer chambers.

The present invention has been described in connection with the preferred embodiments. The invention is not limited only to the above embodiments. It is apparent that various modifications, improvements, combinations, and the like can be made by those skilled in the art.

What is claimed is:

1. A method of running a pulse tube refrigerator having a regenerator and a pulse tube each defining a high temperature end and a low temperature end, the low temperature ends of the regenerator and the pulse tube being communicated with each other, and the high temperature end of the regenerator being connected to a gas compressor, the method comprising:

a cooling step of forming a cold area at the low temperature ends by periodically supplying working gas from the high temperature end of the regenerator to the regenerator and recovering the working gas from the regenerator; and a temperature raising step of raising the temperature of the low temperature ends by steadily, pulsatively or intermittently flowing gas in one direction through a communicating area between the low temperature ends of the regenerator and the pulse tube.

2. A method of running a pulse tube refrigerator according to claim 1, wherein in said temperature raising step, gas is introduced to the high temperature end of one of the regenerator and the pulse tube and discharged from the high temperature end of the other of the regenerator and the pulse tube.

3. A method of running a pulse tube refrigerator according to claim 2, wherein the gas compressor has a jet port for jetting out high pressure gas and a suction port for sucking gas, and in said temperature raising step, gas is supplied from the jet port of the gas compressor to the high temperature end of the one of the regenerator and the pulse tube, and gas is recovered from the high temperature end of the other of the regenerator and the pulse tube toward the suction port of the gas compressor.

4. A method of running a pulse tube refrigerator according to claim 2, wherein in said temperature raising step, gas is supplied from a high pressure gas source toward the high temperature end of the one of the regenerator and the pulse tube, and gas is recovered from the high temperature end of the other of the regenerator and the pulse tube toward the atmosphere or a low pressure gas source.

5. A method of running a pulse tube refrigerator according to claim 1, wherein the pulse tube refrigerator further comprises:

another regenerator of one stage or more serially connected to said regenerator, each stage defining a high temperature end and a low temperature end; and another pulse tube provided in correspondence with each stage of the other regenerator and defining a high temperature end and a low temperature end, the low temperature end of the other pulse tube being communicated with the low temperature end of the other regenerator at the corresponding stage, and wherein in said temperature raising step, gas is steadily, pulsatively or intermittently flowed in one direction through a communicating area between the low temperature end of the other regenerator at least at one stage and the low temperature end of the corresponding pulse tube to raise the temperature of the low temperature ends.

6. A pulse tube refrigerator comprising:

a regenerator filled in with regenerator material and defining a high temperature end and a low temperature end;

a pulse tube defining a high temperature end and a low temperature end, the low temperature end of said pulse tube communicating with the low temperature end of said regenerator;

a gas compressor for periodically jetting out and sucking gas via a gas jet port thereof;

a first gas flow path capable of being opened and closed, said first gas flow path communicating the gas jet port of said gas compressor with the high temperature end of said regenerator;

a second gas flow path capable of being opened and closed, said second gas flow path communicating the gas jet port of said gas compressor with the high temperature end of said regenerator, and being capable of flowing gas only in the direction toward said regenerator or in the direction toward said gas compressor; and a third gas flow path capable of being opened and closed, said third gas flow path communicating the gas jet port of said gas compressor with the high temperature end of said pulse tube, and capable of flowing gas only in the direction toward said gas compressor if said second gas flow path can flow gas only in the direction toward said regenerator, or flowing gas only in the direction toward said pulse tube if said second gas flow path can flow gas only in the direction toward said gas compressor.

7. A pulse tube refrigerator according to claim 6, further comprising a buffer chamber communicated with the high temperature end of said pulse tube via a flow path impedance intervened therebetween, wherein the end of said third gas flow path on the side of said pulse tube communicates with said buffer chamber or a gas flow path between the high temperature end of said pulse tube and said flow path impedance.

8. A pulse tube refrigerator according to claim 6, wherein said regenerator is made of a plurality of sub-regenerator stages each defining a high temperature end and a low temperature end, the low temperature end of said pulse tube communicates with the low temperature end of said regenerator at one stage of the plurality of sub-regenerator stages, and the pulse tube refrigerator further comprises:

a plurality of other pulse tubes each defining a high temperature end and a low temperature end, each of said other pulse tubes corresponding to each stage of said regenerator, and the low temperature end of each of said other pulse tubes communicates with the low temperature end of said regenerator at a corresponding stage of the plurality of sub-regenerator stages; and a plurality of fourth gas flow passages for communicating each high temperature end of said other pulse tubes with the gas jet port of said gas compressor, said fourth gas flow passages being capable of flowing gas only in the same direction as said third gas flow path.

9. A pulse tube refrigerator comprising:

a regenerator filled in with regenerator material and defining a high temperature end and a low temperature end;

a pulse tube defining a high temperature end and a low temperature end, the low temperature end of said pulse tube communicating with the low temperature end of said regenerator;

a buffer chamber communicating with the high temperature end of said pulse tube via a flow path impedance intervened therebetween;

a gas compressor having a jet port for jetting out high pressure gas and a suction port for sucking gas;

a first gas flow path capable of being opened and closed, said first gas flow path communicating the jet port of said gas compressor with the high temperature end of said regenerator;

a second gas flow path capable of being opened and closed, said second gas flow path communicating the suction port of said gas compressor with the high temperature end of said regenerator; and a third gas flow path capable of being opened and closed, said third gas flow path communicating one of the jet port and the suction port of said gas compressor with said buffer chamber or a gas flow path between the high temperature end of said pulse tube and said flow path impedance.

10. A pulse tube refrigerator according to claim 9, wherein said regenerator is made of a plurality of sub-regenerator stages each defining a high temperature end and a low temperature end, the low temperature end of said pulse tube communicates with the low temperature end of said regenerator at one stage of the plurality of sub-regenerator stages, and the pulse tube refrigerator further comprises:

a plurality of other pulse tubes each defining a high temperature end and a low temperature end, each of said other pulse tubes corresponding to each stage of said regenerator, and the low temperature end of each of said other pulse tubes communicates with the low temperature end of said regenerator at a corresponding stage of the plurality of sub-regenerator stages; and a plurality of fourth gas flow passages for communicating each high temperature end of said other pulse tubes with the jet port or the suction port of said gas compressor connected to said third gas flow path, said fourth gas flow passages being capable of flowing gas only in the same direction as said third gas flow path.

* * * * *